US005141077A

United States Patent [19]

Zuercher

[11] Patent Number: 5,141,077

[45] Date of Patent: Aug. 25, 1992

[54] TRESTLE SUPPORT BRACKET

[76] Inventor: Loren G. Zuercher, 728 Audubon Dr., Pekin, Ill. 61554

[21] Appl. No.: 633,032

[22] Filed: Dec. 24, 1990

[51] Int. Cl.[5] ..... B27B 21/00; B25H 1/06

[52] U.S. Cl. ..... 182/185; 182/224

[58] Field of Search ..... 182/181-186, 182/224

[56] References Cited

U.S. PATENT DOCUMENTS 2,376,153 4/1945 Karow ..... 182/185

FOREIGN PATENT DOCUMENTS 166057 11/1955 Australia ..... 182/185

929833 7/1947 France ..... 182/185

*Primary Examiner*—Reinaldo P. Machado

*Attorney, Agent, or Firm*—Beveridge, DeGrandi & Weilacher

[57] ABSTRACT

This is a trestle support bracket comprised of a main member referred to as a bracket housing, which is coupled to the trestle cross-beam and a second member, referred to as the wedge. The bracket housing is a four sided, open bottomed, walled frustum with inside surfaces (ridged) as the opposing inclined leg contact walls. The wedge member has an included angle which matches that of the inclined, ridged surfaces of the bracket housing. When trestle support legs are placed in position in the bracket housing and the wedge member is inserted between the legs, a bolt passing through the central hole of the wedge member and engaging the central threaded hole of the bracket housing will, when tightened, firmly secure the legs to the housing in an absolutely rigid manner.

13 Claims, 3 Drawing Sheets

TRESTLE SUPPORT BRACKET

TRESTLE SUPPORT BRACKET

This invention relates to trestles or sawhorses used by various artisans such as carpenters, plasterers, paperhangers, mechanics and others to support work surfaces or platforms. This invention relates specifically to an improved bracket which rigidly ties the legs to the beam of the trestle structure.

BACKGROUND OF THE INVENTION

Trestle Support Bracket are many and varied in design. They are also generally very complex, requiring more than average expertise in building such devices as sawhorses using those brackets. Another common problem is the lack of design rigidity which allows sawhorses to soon become "wobbly", even to the point of becoming a safety hazard.

Cross-bracing the legs of wobbly sawhorses with nailed or screwed braces will stop the wobble but makes the items difficult to transport and store.

SUMMARY OF THE INVENTION

Accordingly, several objects of my invention are to provide a Trestle Support Bracket which is:

1. ) Easy to assemble into a Trestle Support such as a sawhorse
2. ) Provides absolute sturdiness and rigidity of assembled trestle
3. ) May be disassembled with comparative ease (for transport and storage)

BRIEF DESCRIPTION OF THE DRAWING

Further objects and advantages of my invention will become apparent from a consideration of the drawings and ensuing description thereof.

DESCRIPTION OF THE PREFERRED EMBODIMENT

Figure 2:
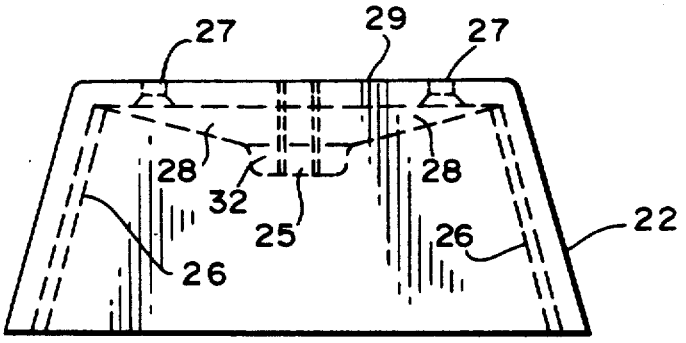
FIG. 2 is an end elevation FIG. 1.
Figure 1:
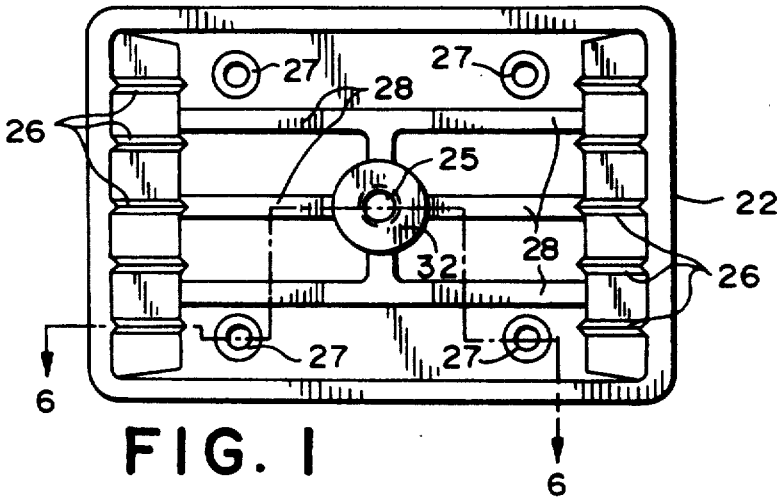
FIG. 1 is a plan view of the open side of the bracket housing (22).
Figure 4:
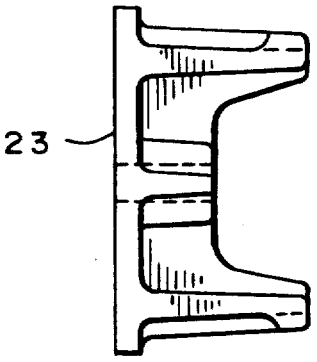
FIG. 4 is a side elevation of FIG. 3.
Figure 3:
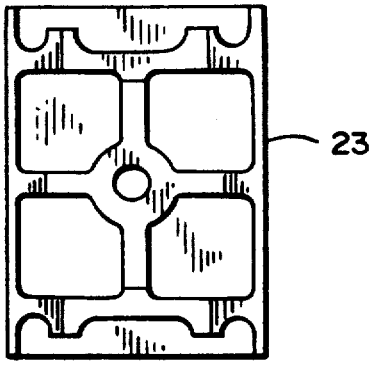
FIG. 3 is a plan view of the bracket wedge.
Figure 5:
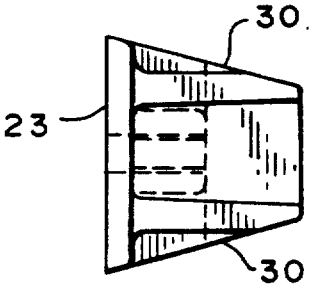
FIG. 5 is an end elevation of FIG. 3.

My invention may best be described as a 4-sided, open bottom, closed frustum bracket housing (22). It has two opposed sides, basically parallel and perpendicular to the frustum and the other two sides at identically inclined and symmetrical angles, relative to the open face and frustum. These inclined walls have raised ridges (26) on the inner surfaces and gusset ribs (28)on the inside housing face behind the frustum wall at a 90 degree angle to the inclined walls.

The upper wall of the housing is substantially horizontal. Its lower surface is provided with a centrally located spacer boss 32 and parallel ribs 28. The lower surfaces of the ribs are inclined to lie perpendicular to the inclined sides of the housing, so that the upper ends of the legs 21 will securely abut against the ribs 28.

Four holes (27) through the frustum all allow the bracket housing to be securely fastened to a support beam. (20) with four screws (31) at the top surface (29) of the frustum.

Figure 6:
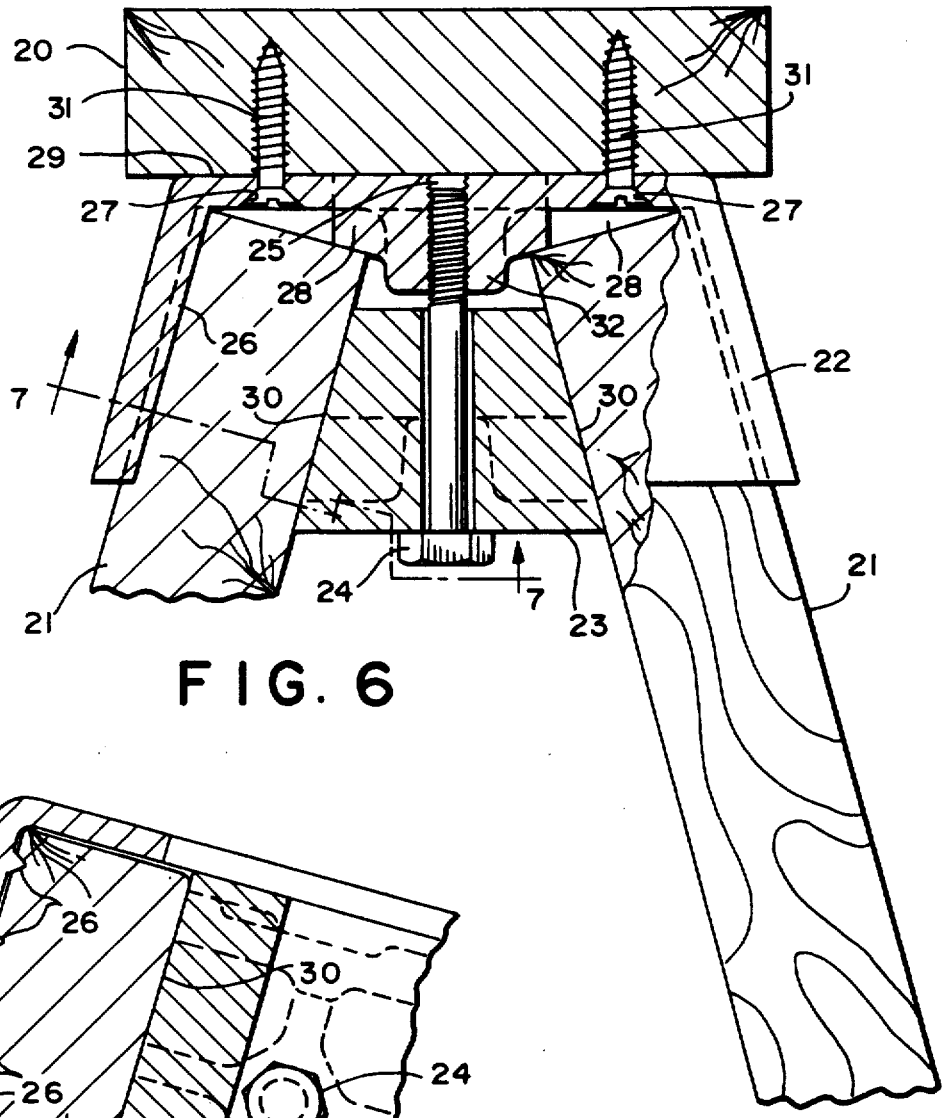
FIG. 6 is an end and sectional view of the typical trestle assembly using my invention.
Figure 7:
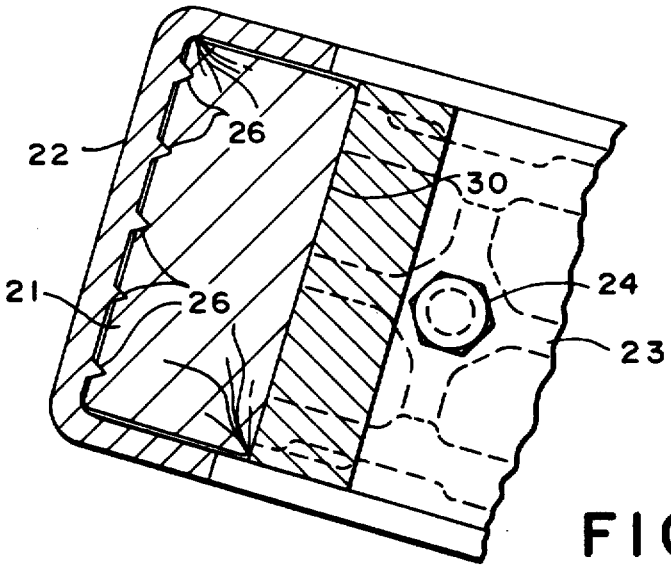
FIG. 7 is an auxiliary sectional view, to illustrate the rigid support locking afforded by this housing and wedge trestle support bracket.
Figure 8:
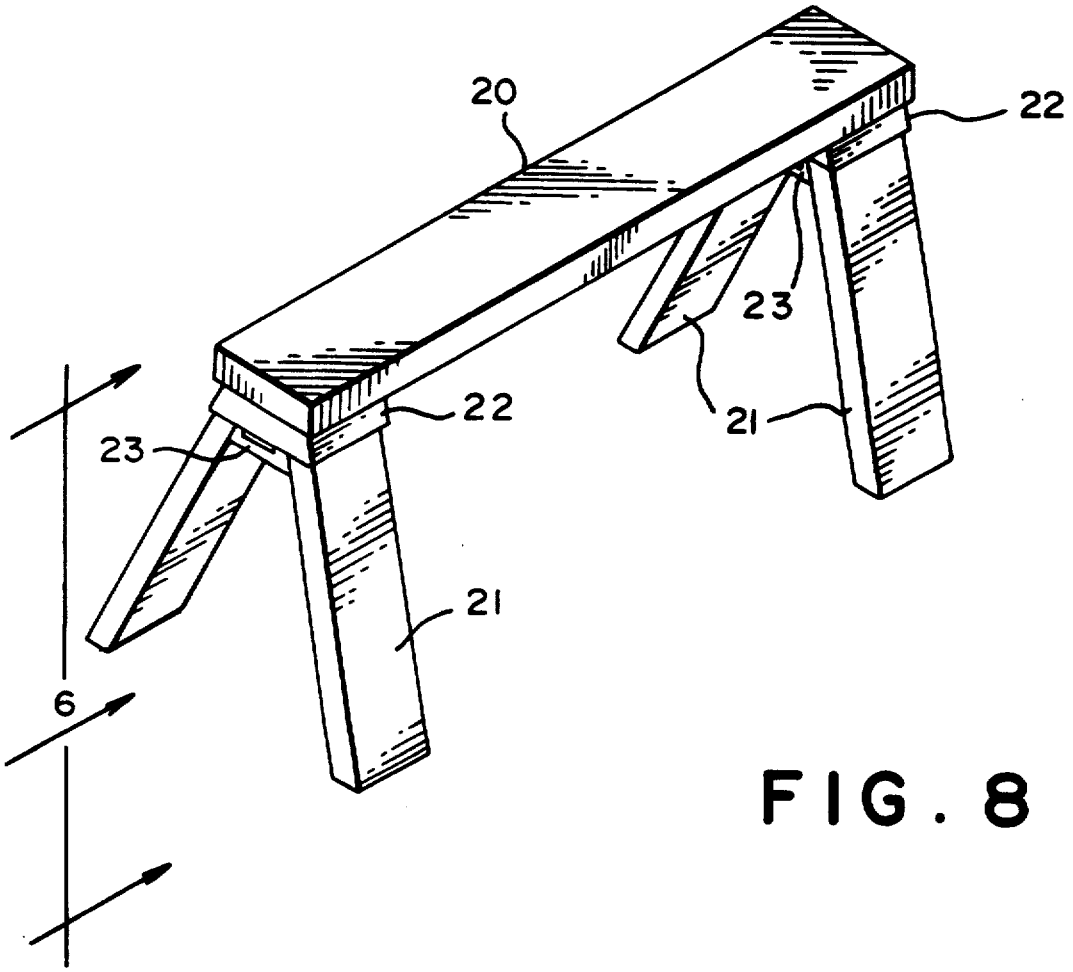
FIG. 8 is a perspective view of the sawhorse.

The drilled and threaded hole (25) in the integral spacer boss (32) of the housing (22) will receive the bolt (24) which has been inserted through the wedge member (23). You will note in FIGS. 6 and 7 that the wedge has lateral and longitudinal ribbing faces (20) which parallel the inclined walls of the bracket housing.

The bracket housing and wedge are aluminum alloy castings which achieve unique design features such as the lateral leg locking ridges on the sloping walls. When the wedge is tightened by the bolt, these housing ridges imbed into the wooden support legs and effectively lock them rigidly into place.

Many cast and formed materials could be used. However, aluminum alloy is the preferred material for reasons of lightness of weight and superior strength. It also resists oxidation without special treatment.

When the support legs (21) are placed into position on each side of the bracket housing (22) (and on opposite sides of the spacer boss (32) and the wedge (23) is in place, tightening the one bolt (24) creates leveraged pressure at the wedge (23) and leg (21) interface (30). This imbeds the bracket housing ridges (26) into the legs (21) resulting in an absolutely rigid, sturdy and stable trestle support structure.

Disassembly for transport or storage requires only the single bolt to be loosened. It need not be removed entirely.

While the above description contains many specificities, these should not be construed as limitations on the scope of my invention. Rather, it is an exemplification of one preferred embodiment thereof.

Many other variations are possible. Following will be a few of these variations.

The angle of inclination of the walls of the bracket housing (22) could be more acute or more obtuse relative to perpendicularity to the beam.

The locking ridges on the inclined walls of the bracket housing could be varied in number, in sectional profile, or in the geometric design of the plan profile (for example, circles, diamonds, points, cross grid, "S" lines, etc.).

The wedge (23) pressure face (30) could also be varied in design form solid to any number of geometric designs.

Another variation might be that of adding extra bolts (24) and matching holes (32) in the wedge (23) and threaded holes (25) in the housing (22).

Accordingly, the scope of my invention should be determined not by the embodiment illustrated, but by the appended claims and their legal equivalents.

I claim:

1. A trestle support bracket assembly for forming a trestle device such as a sawhorse, comprising, a bracket housing which is connectable to a cross beam of the trestle, said bracket having a horizontal upper wall, and outwardly inclined side walls extending downwardly from said upper wall, a wedge which is located between and spaced from said inclined side walls, said wedge having leg-contacting surfaces which face toward and are substantially parallel to said inclined side walls, said wedge and said inclined side walls defining leg-receiving spaces for receiving legs of the trestle device, said bracket housing including an integral spacer extending down from said upper wall, substantially midway between the inclined side walls, said spacer being located to maintain a space between legs which, during assembly, are inserted into the bracket housing into contact with said upper wall, whereby each of said legs is preliminary oriented approximately parallel to one of said inclined side walls, and a bolt extending through said wedge and threadedly engaged with said spacer whereby tightening said bolt moves said wedge against legs in said leg-receiving spaces, said bolt having an upper end which does not extend above said upper wall.

2. A trestle support bracket according to claim 1 wherein the upper wall has a lower surface provided with ribs having inclined lower surfaces which are abutted by upper ends of said legs, said ribs being substantially perpendicular to said outwardly inclined side walls.

3. A trestle support bracket according to claim 2 wherein the bracket housing is formed of aluminum alloy.

4. A trestle support bracket according to claim 2 wherein the outwardly inclined side walls have raised ridges on their interior surfaces, whereby tightening said bolt embeds the ridges in said legs.

5. A trestle support bracket according to claim 2 wherein the horizontal upper wall has openings for receiving screws which attach the bracket to a horizontal beam.

6. A trestle support bracket according to claim 5 wherein the outwardly inclined side walls have raised ridges on their interior surfaces, whereby tightening said bolt embeds the ridges in said legs.

7. A trestle support bracket according to claim 1 wherein the bracket housing is formed of aluminum alloy.

8. A trestle support bracket according to claim 7 wherein the horizontal upper wall has openings for screws for attaching the bracket to a horizontal beam.

9. A trestle support bracket according to claim 7 wherein the outwardly inclined side walls have raised ridges on their interior surfaces, whereby tightening said bolt embeds the ridges in said legs.

10. A trestle support bracket according to claim 9 wherein the horizontal upper wall has openings for screws for attaching the bracket to a horizontal beam.

11. A trestle support bracket according to claim 1 wherein the horizontal upper wall has openings for screws for attaching the bracket to a horizontal beam.

12. A trestle support bracket according to claim 11 wherein the outwardly inclined side walls have raised ridges on their interior surfaces, whereby tightening said bolt embeds the ridges in said legs.

13. A trestle support bracket according to claim 1 wherein the outwardly inclined side walls have raised ridges on their interior surfaces, whereby tightening said bolt embeds the ridges in said legs.

* * * * *